US007197795B2

(12) United States Patent
Fleissner

(10) Patent No.: US 7,197,795 B2
(45) Date of Patent: Apr. 3, 2007

(54) METHOD FOR HYDRODYNAMIC IMPINGEMENT ON A WEB CONTINUOUS MATERIAL WITH WATER JETS AND NOZZLE BEAMS FOR PRODUCING LIQUID JETS

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 388 days.

(21) Appl. No.: 10/450,389

(22) PCT Filed: Dec. 5, 2001

(86) PCT No.: PCT/EP01/14233

§ 371 (c)(1),
(2), (4) Date: Dec. 12, 2003

(87) PCT Pub. No.: WO02/48441

PCT Pub. Date: Jun. 20, 2002

(65) Prior Publication Data

US 2004/0078945 A1 Apr. 29, 2004

(30) Foreign Application Priority Data

Dec. 13, 2000 (DE) ..... 100 61 985

(51) Int. Cl.
*D06B 1/02* (2006.01)

(52) U.S. Cl. ..... 28/104; 28/167

(58) Field of Classification Search ..... 28/104, 28/105, 167, 106; 239/548, 554, 556, 557, 239/560, 459, 553, 553.3, 553.5, 590.5, 590.3; 68/201, 205 R
See application file for complete search history.

(56) References Cited

U.S. PATENT DOCUMENTS 3,042,576 A * 7/1962 Harmon et al. ..... 162/114

(Continued)

*Primary Examiner*—A. Vanatta
(74) *Attorney, Agent, or Firm*—Antonelli, Terry, Stout & Kraus, LLP.

(57) ABSTRACT

The nozzle beam on a device for producing liquid jets in order to impinge said jets upon the fibres of a web of continuous material guided along the beam consists of a beam housing extending along the working width of the continuous web of fibre material, whereby two longitudinal bores placed on top of each other are accommodated in said housing and are separated from each other by means of an intermediate wall provided with continuous boreholes. The nozzle strip required to produce the liquid jets is mounted in a liquid-tight manner in the lower part of the housing and is cross-flown by pressurized water. In order to enable more needle water to reach the fabric than is usual with such a construction, two strips of nozzles are mounted in a housing and must be provided accordingly with pressurized water. This construction also makes it possible to arrange a larger number of nozzle strips and therefore nozzle jets on a drum, which is advantageous with respect to the various needling effects obtained with a nozzle beam.

21 Claims, 3 Drawing Sheets

U.S. PATENT DOCUMENTS 3,493,462 A * 2/1970 Bunting, Jr. et al. ..... 442/405
3,613,999 A * 10/1971 Bentley et al. ..... 239/553.3
4,021,284 A * 5/1977 Kalwaites ..... 156/277
4,069,563 A * 1/1978 Contractor et al. ..... 28/105
4,647,490 A * 3/1987 Bailey et al. ..... 428/131
4,880,168 A * 11/1989 Randall et al. ..... 239/553.5
5,238,644 A * 8/1993 Boulanger et al. ..... 264/557
5,301,400 A * 4/1994 Boulanger ..... 28/105
5,692,278 A * 12/1997 Fleissner ..... 28/105
5,778,501 A * 7/1998 You ..... 28/104
5,827,597 A * 10/1998 James et al. ..... 428/131
5,870,807 A * 2/1999 Beaty et al. ..... 28/167
5,933,931 A * 8/1999 Greenway ..... 28/167
6,253,429 B1 * 7/2001 Zolin ..... 28/104
6,442,810 B2 * 9/2002 Greenway et al. ..... 28/104
6,571,441 B1 * 6/2003 Kobayashi et al. ..... 28/104
6,694,581 B2 * 2/2004 Sternlieb et al. ..... 28/104
2002/0078538 A1 * 6/2002 Ngai ..... 28/104

* cited by examiner

METHOD FOR HYDRODYNAMIC IMPINGEMENT ON A WEB CONTINUOUS MATERIAL WITH WATER JETS AND NOZZLE BEAMS FOR PRODUCING LIQUID JETS

The invention relates to a method for hydrodynamically impinging nonwovens, tissues, woven fabric, or knitted fabric with fluid jets whereby a fluid is sprayed under a high pressure of up to 1,000 bar from fine jet orifices arranged tightly spaced in a row within a jet strip of a jet manifold extending over the working width against the fabric web advancing opposite the jet manifold.

U.S. Pat. No. 4,870,807 discloses an approach whereby a row of jet holes is arranged side by side and spaced extremely tightly together within a jet strip, possibly also providing for two rows of orifices arranged side by side, the orifices being distributed in staggered fashion over the length of the jet strip. This approach provides a water curtain of uninterrupted water jets arranged side by side, thereby also essentially avoiding a line marking due to the indentation action of a particular water jet on the fabric web. The water jets are formed in precisely fabricated orifices within the jet strip; U.S. Pat. No. 3,403,862 may be referred to in this regard.

In many applications, it is advantageous to have a larger volume of water to create the desired effect on the fabric web. This is true, for example, for the fabrication of perforated nonwovens by means of hydrodynamic needling. However, it is not desirable to enlarge the diameter of the jet holes to allow passage of more water since the effective action of the water jet simultaneously with the desired compaction of the nonwoven is thereby reduced.

On the other hand, approaches may be conceived whereby these jets impact a fabric web in a configuration in which the jet holes are arranged within a jet strip immediately back to back but with greater spacing than with two rows of possibly staggered jet holes; and in which the necessarily required spacing of two complete side-by-side jet manifolds is too large.

The goal of the invention is therefore to find a solution in which a larger volume of fluid, or multiple tightly spaced jets, may be applied to the fabric using a conventional jet manifold with jet strips mounted in a sealed manner within this manifold. To achieve this solution, the invention provides that the sprayed fluid be distributed, in an unmodified manner, uniformly over the working width of the fabric web, but that more than one water jet simultaneously impact a small region of the advancing fabric web in a back-to-back orientation in the direction of transport. This means that, advantageously, a greater volume of fluid may be sprayed onto a particular impact site, or multiple impact sites, on the fabric web simultaneously by multiple water jets from multiple jet strips—as viewed in the direction of the advancing fabric web. It is also conceivable in this approach that more than one water jet simultaneously impact a small region between 1 cm and 20 cm, preferably 8 cm, of the advancing fabric web in line back-to-back in the direction of transport.

These ideas differ from the solutions of U.S. Pat. No. 3,214,819 or U.S. Pat. No. 3,873,255. These disclose manifolds which extend over the working width of the fabric web. The previously known individual jets are arranged in part in opposing fashion, thereby also spraying water in concentrated form onto one location of the advancing nonwoven web, but in fact in point form onto one location, not over the entire working width. Even if the jets extended in slit form over the working width, this idea could not be transferred to the invention. The approach here involves the generation of fine jets, and is possible only using the previously known jet manifold design including pressure chambers and pressure distribution chambers. If the idea of the two US documents were transferred to the jet manifold required here according to U.S. Pat. No. 5,870,807, the effect according to the invention could not be achieved; the dimensions of the interfering housings would obstruct each other.

Using the idea according to the invention of generating multiple water jets arranged in one jet manifold arranged back-to-back in the direction of transport also allows various effects, such as patterns, to be obtained. In the case in which the jet manifold oscillates at a defined frequency, lines and indentations are pressed into the fabric web by each jet, thus enabling a complete pattern to be created. Since the water jets emerge from one jet manifold with a defined spacing, and the jet manifold oscillates at a defined frequency, two lines each are drawn back-to-back in the fabric web which, depending on the speed of the fabric web, may even be used to complete, for example, a braided pattern, that is, a pattern with staggered crossing serpentine lines. This is also true for two back-to-back emerging water jets, and of course even for a multiple of this, where the jet orifices are then incorporated laterally side by side in the jet strip.

A jet manifold is composed of an upper section extending over the working width of the web, and a lower section, wherein a pressure chamber of round cross-section extends over the length of the upper section, to which chamber the fluid is fed under pressure, for example, at the front end; wherein a pressure distribution chamber is provided in parallel to said chamber behind a partition in the lower section, the pressure distribution chamber being connected to the pressure chamber by fluid passages located in the partition; and wherein additionally the jet strip with the orifices is mounted in fluid-tight fashion in the lower section.

A jet manifold of this type is known from European Patent A-0 725 175. Compared to the designs of U.S. Pat. No. 4,069,563 or GDR Patent A-220 060 or German Patent C-37 27 843, this manifold has the advantage of a simpler design and less anticipated downtime for maintenance. This design ensures a uniform distribution of fluid over the length of the jet strip.

Only a limited peripheral region is available over the circumference of the drum transporting the fabric web during needling, especially in the case of meander-type web routing. However, multiple jet manifolds are required to obtain the desired treatment effect. These jet manifolds require a certain irreducible area in the circumferential direction, with the result that there is a maximum number of jet manifolds per drum.

In addition, only a limited volume of fluid per jet manifold may be applied to the web. For many treatment processes, however, this volume is insufficient, for example, to produce holes in the nonwovens where the individual fibers must be flushed with a large amount of water flowing through the nonwoven at the edges of the holes, that is, at one and the same location of the drum or of the nonwoven. In this case, it is also not possible to increase the number of jet manifolds at multiple drums extending the length of the overall unit, since only one drum, such as that in European Patent A-1 001 064, with pins for the holes, may be employed to produce the holes.

These problems may be solved by mounting two jet strips with orifices for the jet holes in the housing forming the jet manifold, the two jet strips being advantageously located close together in the housing of the jet manifold. This approach eliminates at least one wall of the otherwise two adjacent jet manifolds which must be attached to accommodate the water connections as well as attached with a separation between them within the machine frame. To achieve an optimal design, one pressure chamber followed by one pressure distribution chamber each should be allocated within the one jet manifold housing to the two jet strips to supply and distribute the fluid, the two pressure distribution chambers, or possibly pressure chambers as well, being arranged close together in the housing of the jet manifold. With this type of "duplex" jet manifold, multiple jet strips may be located at least over the available circumference of a drum, such as a pin-type drum; in other words, multiple water jets may be involved.

This design may also be used to affect the circumferential spacing of the water jets striking the fabric web. In addition to the fact that with two jet strips arranged closely together in one jet manifold, the distance to the following water jet curtain is closer, the two lines of the pressure distribution chambers arranged back-to-back along with their associated jet strips may be oriented obliquely relative to each other in the one jet manifold housing such that the water jets striking the fabric web are directed in an arrow shape toward each other, and thereby disposed even closer together at the impact site. The interface of the two jets generated in one housing with the two jet strips may either be on the fabric itself or behind the fabric. Of course, it is also possible to match the inclination of the fluid jets configured in an arrow shape only to the diameter of the drum located directly under the jet manifold and transporting the fabric web, such that the water jets always impact the fabric web vertically.

If the goal is to have the water jets from two jet strips impact the fabric web very closely together, or even touch, it is advantageous to employ only one pressure chamber in the jet manifold for the two jet strips, and to control this pressure chamber orifice by the particular fluid passages in a two-fold manner.

The drawings illustrate the functional principle of a jet manifold according to the invention.

Figure 1:
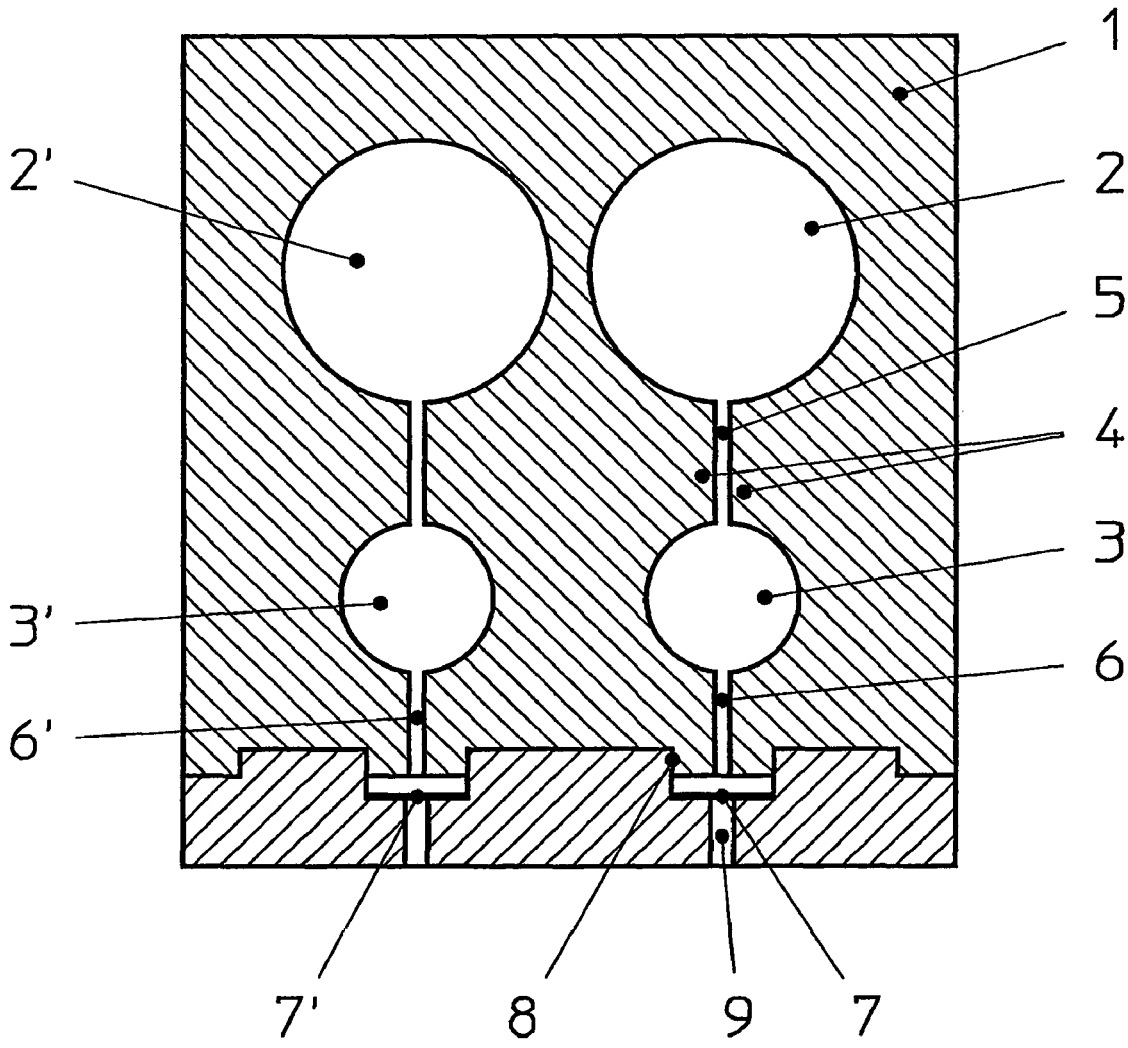
FIG. 1 is a section through a "duplex" jet manifold.

In principle, a jet manifold is composed of components as described in European Patent A-0 725 175. For this reason, the disclosure of European Patent A-0 725 175 is referenced here.

A jet manifold is composed of a housing 1 with two longitudinal orifices 2 and 3. The two longitudinal orifices 2, 3 are separated by a partition 4 in which the passages 5 connecting orifices 2, 3 are located. Opposite these passages and in line on the other side of orifice 3 is a narrower slit 6 from which the fluid emerges. A jet manifold of this basic design is also advantageous here in unmodified form. Water under a high pressure of up to 1000 bar enters at the front side of orifice 2, which acts as a pressure chamber, in the upper section of the housing; the water is distributed along the entire length of the jet manifold through passages 5 into the pressure distribution chamber 3 located in the lower section of the housing. In the device shown, a base component having a plurality of bolts, not shown here, is attached to the bottom of housing 1. The jet strip 7 required to generate the fluid jets is mounted in a groove 8 in the base component. The fluid jets then emerge from the jet manifold through slit 9 in the center below jet strip 7 and impact the fabric web transported on, for example, the drum 10.

In the jet manifold of FIG. 1, two orifices 2 and 2' for the pressure chambers, and two orifices 3 and 3' for the pressure distribution chambers, have been incorporated into housing 1. As a result, two jet manifolds with all the orifices and components described are essentially located in one housing 1, with the result that there is a savings of one housing. The new housing of FIG. 1 is in fact somewhat larger in its lateral dimensions, but smaller than the two manifolds in the previously known design.

Based on this design of a jet manifold, the two jet strips 7 and 7' are spaced much closer together than is the case with two jet manifolds, and as a result, more jet strips may be located on one drum 10, and thus more generatable fluid jets 11 may impact the drum than in previously known approaches.

Figure 2:
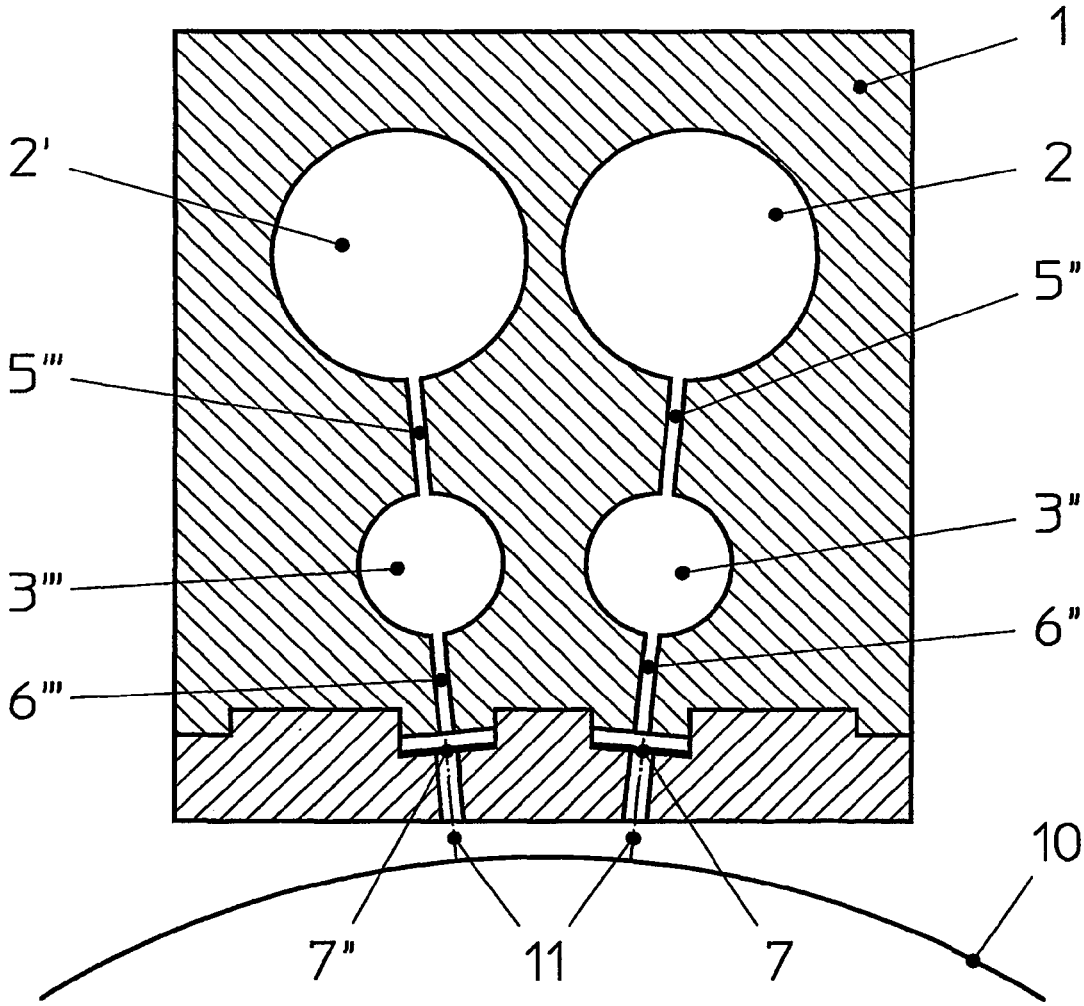
FIG. 2 is also a section through a "duplex" jet manifold with jets directed obliquely toward each other.

The design of FIG. 1 is employed when the fabric web is routed on a single horizontally moving belt. If the web is routed over a drum, then the design of FIG. 2 is recommended in which the water jets from the two jet strips 7, 7' impact the fabric web vertically even with this routing over a drum. This result is made possible by having the pressure chambers 2 and 2' remain unchanged, but by boring the two pressure distribution chambers 3", 3'" in a mutually offset fashion such that the passages 5" and 5'", and slits 6" and 6'" are oriented in line in an arrow-shaped configuration toward each other.

The jet manifolds of FIGS. 1 and 2 may also be employed to produce a line pattern with a variety of individually recognizable lines. For this purpose, manifold 1 should preferably oscillate at a defined frequency of up to 50 Hz, preferably at 20 Hz. Since the water jets from the two jet strips 7, 7' impact the fabric web in a timewise-staggered fashion, due to their spacing relative to the advancing fabric web, any type of line pattern may be imprinted into the fabric web by the water jets when the manifold is oscillating. To this end, the jet strips may also be provided with a special perforation having jet holes or groups of holes with greater spacing. The perforation may also begin at the end of the strip at varying distances to the extreme end—in other words, the zero-point setting may vary. In addition, it is possible to produce two different types of needling with one jet manifold. The first jet strip may be used to produce a full two-dimensional needling of the nonwoven product, and the second jet strip may be employed to impart a pattern, for example, a striped pattern with parallel lines of whatever type desired.

Figure 3:
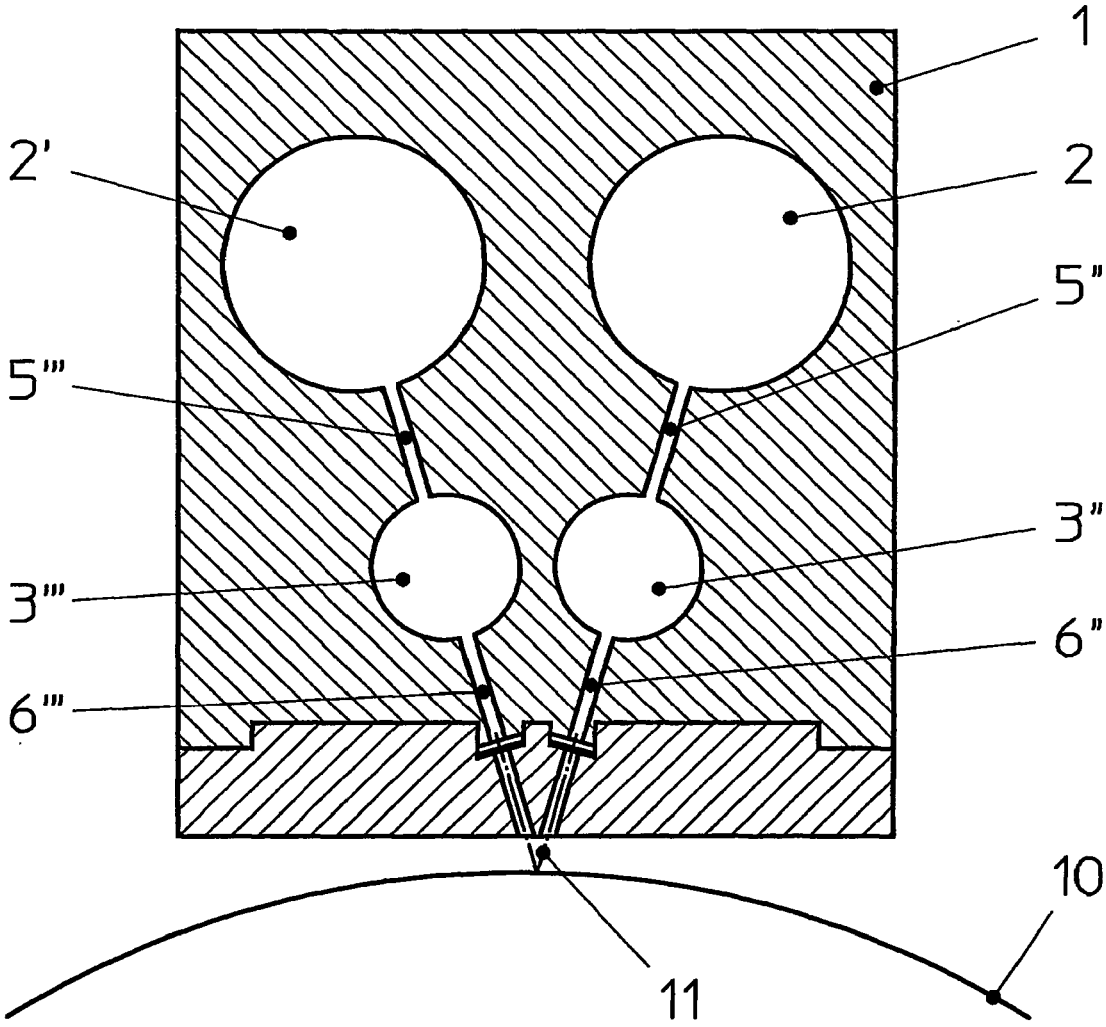
FIG. 3 is also a section through a "duplex" jet manifold, but having jets directed toward each other so that the jets meet at the fabric web.

In the case of an inclination of the water jets in an arrow-shaped orientation toward each other, this inclination may be increased, as shown in FIG. 3, by orienting the lines of back-to-back components 6", 3", 5" and 2, and analogously, 6'", 3'", 5'" and 2', in a corresponding arrow-shaped configuration in housing 1, thereby creating the prerequisite for the water jets 11 generated at jet strips 7, 7' to meet at the fabric on drum 10 due to the now possible greater inclination. Instead of two pressure chambers 2 and 2', one pressure chamber may be sufficient for this design, the two passages 5" and 5'" entering this pressure chamber. This is, of course, also possible with other embodiments. The result is a method in which it is possible to apply more water than previously known simultaneously to one and the same piece of fabric by employing sharply defined, bundled water jets from a jet manifold.

The invention claimed is:

1. Method for hydrodynamically impinging nonwovens, tissues, woven fabric, or knitted fabric with fluid jets, comprising spraying a fluid under a high pressure of up to 1000 bar from fine jet orifices arranged tightly spaced in rows within a plurality of jet strips of a jet manifold extending over a working width against a fabric web advancing opposite the jet manifold, wherein the sprayed fluid is distributed uniformly in an unmodified fashion over the working width of the fabric web, but is delivered to each of the plurality of jet strips by one of a plurality of pressure distribution chambers, the pressure distribution chambers being arranged side-by-side in a single jet manifold so that at least two fluid jets simultaneously impact a small region of the advancing fabric web in a back-to-back orientation in the direction of transport.

2. Method according to claim 1, wherein the at least two fluid jets simultaneously impact a small region between 1 cm and 20 cm of the advancing fabric web in line back-to-back in the direction of transport.

3. Method according to claim 1, wherein a large volume of fluid is sprayed simultaneously from multiple water jets emerging from one jet manifold onto one impact site on the fabric web.

4. Method according to claim 1, wherein different patterns are applied to the fabric web using one jet manifold.

5. Method according to claim 1, wherein the one jet manifold is moved back and forth in its longitudinal direction.

6. Method according to claim 5, characterized in that the one jet manifold moves at a rate between 5 Hz and 50 Hz.

7. Method according to claim 5 wherein, depending on the speed of the advancing fabric web, different patterns are pressed into the fabric web by the fluid jets from the jet orifices.

8. Jet manifold on a device for generating fluid jets for jet impingement of fibers of a web transported along the manifold by a drum or continuous belt, comprising a single housing having an upper section extending over the working width of the web and a lower section; a plurality of pressure chambers of round cross-section over their length located in the upper section, each of the pressure chambers supplying fluid under pressure; a plurality of pressure distribution chambers provided in parallel to the pressure chambers in the lower section behind a partition, each of the pressure distribution chambers being connected to each of the pressure chambers by a fluid passage located in the partition; and a plurality of strip-shaped jet plates having orifices for the fluid jets mounted in the lower section, each of the jet plates being connected to each of the pressure distribution chambers.

9. Jet manifold according to claim 8, wherein the plurality of jet strips are spaced close together at a distance of between 0.5 cm and 20 cm.

10. Jet manifold according to claim 8, wherein, within the single housing, two lines of pressure chambers, two pressure distribution chambers, and two jet strips are provided.

11. Jet manifold according to claim 10, wherein the two pressure chambers and pressure distribution chambers are spaced close together within the single housing of the jet manifold.

12. Jet manifold according to claim 10, wherein the two lines of pressure chambers and pressure distribution chambers, along with the associated passages, are oriented adjacent to each other in parallel within the single housing, whereas axes of the orifices of one of the jet strips are oriented obliquely toward axes of the orifices of another of the jet strips such that the fluid jets impacting the fabric web are directed toward each other in an approximately arrow-shape configuration.

13. Jet manifold according to claim 10, wherein the two lines of pressure chambers and pressure distribution chambers along with axes of the orifices of the associated jet strips are oriented obliquely toward each other within the single housing, such that the fluid jets impacting the fabric web are directed toward each other in an approximately arrowshape configuration.

14. Jet manifold according to claim 13, wherein the jets from the two adjacent jet strips impact the fabric web based on the orientation of the jet strips in the single housing.

15. Jet manifold according to claim 13, wherein the jets of the two adjacent jet strips in the one jet manifold meet behind the fabric web based on the orientation of the jet strips in the jet manifold.

16. Jet manifold according to claim 13, wherein an inclination of the fluid jets directed toward each other in an arrow shape are matched to a diameter of the drum relative to the fabric web immediately below the jet manifold provided with two jet strips, and transporting the fabric web, such that the jets impact the fabric web vertically.

17. Jet manifold according to claim 8, wherein the jet strips are provided with orifices spaced at a greater distance of between 1 mm and 20 mm.

18. Jet manifold according to claim 17, wherein a group of multiple orifices are located immediately adjacent to each other, but that this group in turn is separated from another group by a greater distance of between 1 mm and 20 mm.

19. Jet manifold according to claim 8, wherein the orifices of the jet strips arranged back-to-back in the direction of transport are arranged in a staggered orientation adjacent to each other.

20. Jet manifold according to claim 19 wherein orifices of a first jet strip are arranged with respect to orifices of a second jet strip such that a lateral zero position of the orifices of the first jet strip is laterally offset relative to those of the second jet strip, but are otherwise provided with the same spacing.

21. Jet manifold according to claim 10, wherein the two jet strips comprise a first jet strip of tightly spaced jet holes for two-dimensional needling, and a second jet strip transport with jet holes which are incorporated with greater spacing so as to produce a line pattern.

* * * * *